US006578741B2

(12) United States Patent
Ritsche et al.

(10) Patent No.: US 6,578,741 B2
(45) Date of Patent: Jun. 17, 2003

(54) DISPENSER AND METHOD FOR DISCHARGING MEDIA

(75) Inventors: Stefan Ritsche, Eigeltingen (DE); Juergen Greiner-Perth, Gottmadingen (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 0 days.

(21) Appl. No.: 09/975,542

(22) Filed: Oct. 11, 2001

(65) Prior Publication Data

US 2002/0066752 A1 Jun. 6, 2002

(51) Int. Cl.[7] ..... B67B 5/00

(52) U.S. Cl. ..... 222/153.13; 222/642; 128/200.23

(58) Field of Search ..... 222/153.13, 321.6, 222/321.9, 641, 642, 644; 128/200.23, 200.21

(56) References Cited

U.S. PATENT DOCUMENTS

| | | | | | |
|---|---|---|---|---|---|
| 4,034,757 | A | * | 7/1977 | Glover | 128/260 |
| 4,921,142 | A | * | 5/1990 | Graf et al. | 222/162 |
| 5,335,823 | A | * | 8/1994 | Fuchs et al. | 222/36 |
| 5,988,449 | A | * | 11/1999 | Fuchs et al. | 222/189.11 |
| 6,189,739 | B1 | * | 2/2001 | Von Schuckmann | 222/182 |
| 6,234,366 | B1 | * | 5/2001 | Fuchs | 222/642 |
| 6,257,454 | B1 | * | 7/2001 | Ritsche | 222/153.13 |
| 6,427,684 | B2 | * | 8/2002 | Ritsche et al. | 128/200.23 |
| 6,427,878 | B1 | * | 8/2002 | Greiner-Perth et al. | 222/391 |
| 6,443,370 | B1 | * | 9/2002 | Brulle et al. | 239/333 |
| 6,454,185 | B2 | * | 9/2002 | Fuchs | 239/338 |
| 2002/0066753 | A1 | * | 6/2002 | Greiner-Perth et al. | 222/321.6 |

FOREIGN PATENT DOCUMENTS

| | | | |
|---|---|---|---|
| DE | 4027669 | 3/1992 | B65D/83/76 |
| DE | 19807921 | 8/1999 | A61J/7/04 |
| EP | 0500249 | 2/1992 | B05B/11/04 |
| EP | 472915 | 3/1992 | B05B/11/00 |
| GB | 1189592 | 1/1968 | F04B/9/14 |
| WO | 9800354 | 1/1998 | B65D/83/40 |

* cited by examiner

*Primary Examiner*—Ehud Gartenberg
*Assistant Examiner*—Frederick C. Nicolas
(74) *Attorney, Agent, or Firm*—Quarles & Brady LLP

(57) ABSTRACT

In a dispenser, particularly an atomizer, which is used for flowable substances, particularly pharmaceuticals, use is made of a pump, which must be actuated one or more times for priming purposes. Its discharge nozzle (14) is covered by a protective cap (38), which is suitable to collect and store the medium, which is discharged during the priming strokes and before the start of the useful strokes. During the priming strokes the protective cap (38) is secured on the dispenser (11). This is brought about in that a locking (40) for the protective cap is only released when the priming strokes have been performed. This can take place by electrical actuation or by material change under the influence of the medium to be discharged. According to a variant the protective cap is not itself locked, but an actuation locking takes place if the protective cap has not been fitted for the priming strokes.

14 Claims, 4 Drawing Sheets

DISPENSER AND METHOD FOR DISCHARGING MEDIA

BACKGROUND OF THE INVENTION

The invention relates to a dispenser for media, particularly for flowable pharmaceuticals, having a pump, which is required for the suction of at least one priming stroke, and having a discharge opening more particularly constructed as a spraying nozzle, which is covered by a protective cap prior to a useful or effective discharge of the medium.

Mechanical, manually operated piston pumps, normally constructed as single-acting thrust piston pumps, must prior to their initial actuation suck in the medium into the pump filled with air during manufacture. This is called priming. For this purpose a few, usually one to three strokes are required, during which the air upstream of the pump cylinder escapes through the discharge opening, whilst the medium flows in by means of a pump inlet valve. Although in the case of a pump manufactured with high precision the number of priming strokes can be forecast in a satisfactory manner it is unavoidable that at least during the last priming strokes medium passes out of the discharge opening and is e.g. atomized.

Certain pharmaceutical administered with such dispensers, e.g. in oral or nasal manner, are so specifically tailor-made to a specific clinical picture that it must be ensured that no-one other than the patient participates in the administration. Thus, e.g. a nurse preparing such a dispenser for use by the patient, may inhale the pharmaceutical if the final priming stroke is sprayed into space.

For particularly dosage-critical pharmaceuticals dispensers have already been developed (U.S. Pat. Ser. 6,234,366), which in each case release one or more actuation strokes only in specific time intervals in order to avoid overdoses.

OBJECT OF THE INVENTION

The object of the invention is to provide a dispenser and a method for the discharge of media, in which the priming on of the pump takes place without harming the person performing said operation.

SUMMARY OF THE INVENTION

The invention defines a dispenser having locking means ensuring a priming actuation with the protective cap fitted.

According to the method of the invention the medium which may be delivered during at least one priming stroke is discharged into the protective cap.

The protective cap can receive the medium quantity sprayed, injected or dripped therein, e.g. in a sponge-like element. For the actuation stroke the protective cap is removed or optionally automatically ejected.

There are several possibilities for performing the invention. The locking means can lock the protective cap on the dispenser until at least one priming stroke has been performed. Said locking can take place mechanically and also unlocking can be brought about mechanically or by an electrical or electronic control. It is possible to design the aforementioned time-dependent locking circuit in such a way that e.g. at the start of the use cycle a specific number of priming strokes is only released if the protective cap is fitted. The latter can remain locked or it can e.g. be ensured by means of an electric contact between the protective cap and the dispenser casing that the protective cap is fitted during said priming strokes and otherwise no release takes place.

However, it is also possible in the case of a liquid medium to use the liquid released at the end of the priming stroke in order to correspondingly influence moisture-dependent components. Thus, the interior of the protective cap can contain a moisture sensor, which emits an electric signal for the release of the protective cap.

A particularly simple construction can have a moisture-dependent component, which blocks the protective cap in the dry state, whereas it softens when medium contact occurs and releases the said cap, e.g. a gelatin ring. This would have the advantage of receiving the medium passing out.

Other mechanical solutions for the extraction lock or barrier of the protective cap are possible, e.g. in the form of a counting device advanceable by actuating strokes. Thus, EP 472 915 B discloses a dispenser, which has a counting device for the number of actuating strokes in the form of a rotatable ring. Said ring can be used to block the protective cap e.g. for the first three strokes and then release the same.

Thus, a dispenser, particularly an atomizer is created, whose discharge nozzle is covered by a protective cap able to collect and store the medium discharged during the priming strokes and before the start of the useful strokes. The protective cap is secured on the dispenser during the priming strokes. This is brought about in that a locking is provided for the protective cap and which is only released when the priming strokes have been performed. This can take place by electrical actuation or by a material change under the influence of the medium to be discharged. According to a variant, the protective cap is not itself locked, but actuation is prevented if the cap is not fitted for the priming strokes.

These and further features can be gathered from the claims, description and drawings and the individual features, both singly or in the form of sub-combinations, can be implemented in an embodiment of the invention and in other fields and can represent advantageous, independently protectable constructions for which protection is hereby claimed. The subdivision of the application into individual sections and the subheadings in no way restrict the general validity of the statements made thereunder.

BRIEF DESCRIPTION OF THE DRAWINGS

Embodiments of the invention are described hereinafter relative to the drawings, wherein show.

DETAILED DESCRIPTION OF PREFERRED EMBODIMENTS

Figure 1:
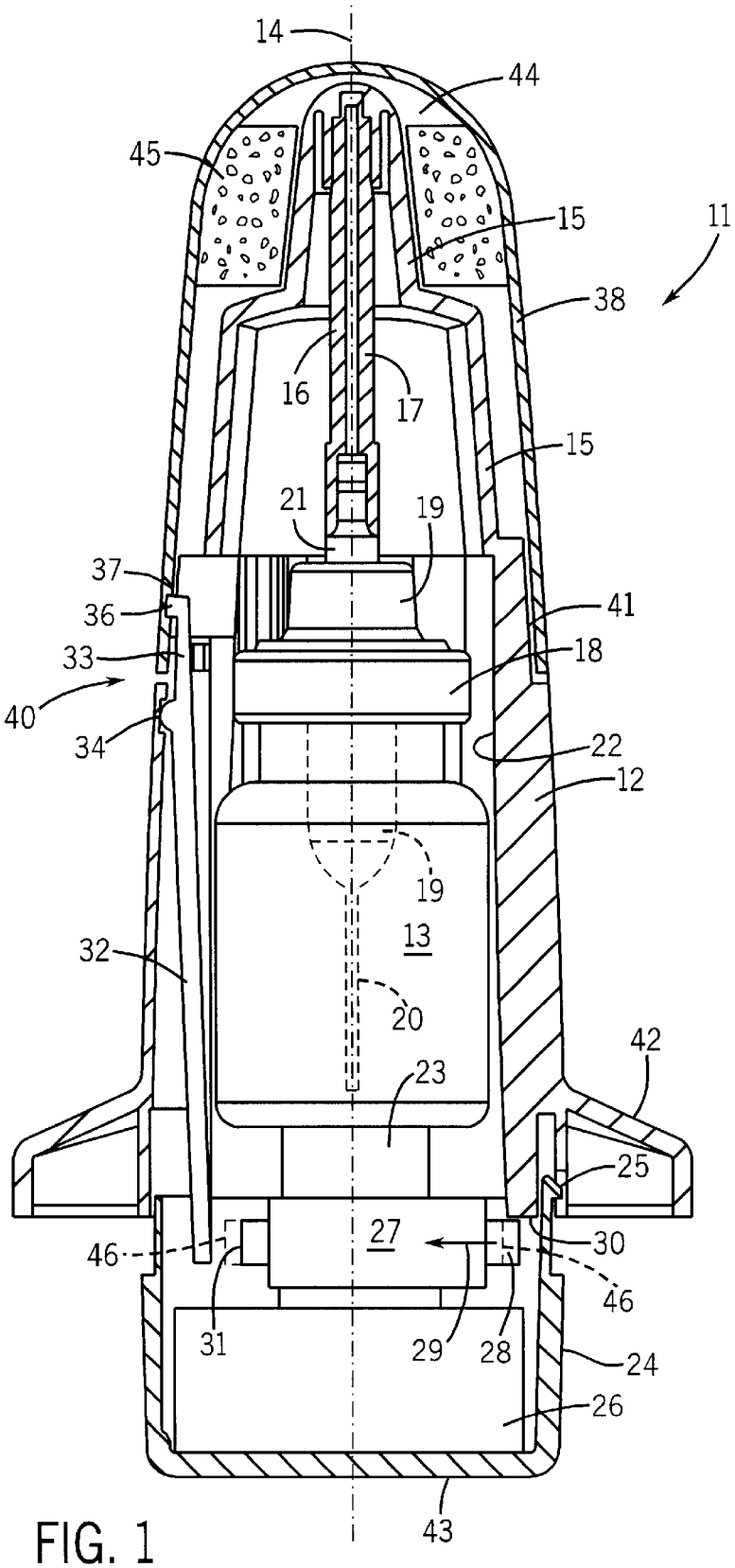
FIG. 1 A longitudinal section through a dispenser with an electrically actuated, mechanical lock for the protective cap.

FIG. 1 shows a dispenser 11 containing in a base casing 12 a container 13 for a medium to be discharged in the form of a substantially cylindrical bottle. As an atomizer it is provided with a discharge opening 14, constructed as an atomizer nozzle, in a projecting, stub-like casing section 15, which is also referred to as a nose adaptor, because it is suitable to spray the medium contained in the container 13, namely a pharmaceutical, into a nostril of patent.

The medium is supplied to the nozzle 14 through a discharge channel 16 formed in a connecting ram 17. Close to the nozzle the ram has lateral discharge openings and simultaneously forms a wall of spiral turbulence chambers for producing a spray cone at the nozzle.

By means of a crimp closure 18 a pump 19 is fixed in the opening of the container 13 and extends into said container and sucks in medium by means of a riser 20. It is a per se known thrust piston pump, such as is e.g. known from GB 1 189 592. In the suction strand it has a ball as the inlet valve and an outlet valve loaded by an elastic piston collar and openable by the liquid pressure in the pump. However, a different type of thrust piston pump can be used.

The container 13 is longitudinally movably guided in an inner, cylindrical and optionally ribbed casing opening 22. By means of a not shown spring element, e.g. an inner plastic spring, it is loaded downwards in FIG. 1 and its bottom rests on an actuating plunger 23, which is provided in a dome-shaped actuating pusher 24. The actuating pusher is axially upwardly movably guided on the base casing 12 by a specific amount (lift) and locks on the same by means of several detents 25. In the actuating pusher 24 is provided an electronic time lag circuit 26, which also contains an electric battery and whose function will be described hereinafter. It includes an electromagnetic transducer, which is symbolized here as an electromagnet 27. Its armature 28 is movable from the normal position shown in FIG. 1 in the direction of the arrow 12, if it is correspondingly controlled by the circuit 26.

The armature 28 cooperates with a stop face 30 on the base casing 20 in order to block the actuating pusher, if the armature is in the starting position shown. However, the armature 28 can act with its opposite end face on the longer arm of a two-armed lever 32, which is pressed by a sectionally shown leaf spring 33 with a bearing cam 34 against a casing wall in the interior of a groove 35 of the base casing. As a result a locking bolt 36 on the shorter lever arm is held in a recess 37 of a protective cap 38, for as long as the lever is not operated. This construction forms a locking means 40 for the protective cap, which engages over the nose adapter 15 and consequently in particular the discharge opening 14. It is shaped like a cap or sleeve with a spherical segmental bottom. Its area close to the mouth rests on a corresponding locking face 41 of the base casing 12 and, as described, is secured there by the locking means 40.

The casing has lateral actuating shoulders 42 on which can be rested two fingers of the hand of the user, if he holds the dispenser between said fingers and presses with the thumb on the actuating face 43 of the pusher 24.

Within the protective cap is formed a storage space 44, because particularly in the upper area of the cap it has a greater distance from the nose adapter 15. In said space is provided as the storage element 45 a foam or sponge-like element, which surrounds in annular manner the nose adapter 15.

The dispenser according to FIG. 1 functions as follows. When the dispenser has been installed and the container 13 is filled with a pharmaceutical or another medium, normally the cylinder of the pump 19 is empty, i.e. filled with air. On initiating at the start of the treatment of the patient with the pharmaceutical, the circuit 26 releases a few priming strokes. It emits a corresponding signal to the electromagnet 27, which moves the armature 28 into the broken line priming position 46, where the dispenser is admittedly released for actuation, but the protective cap locking by the locking means 40 is still present. The user, who optionally receives a corresponding acoustic or optical signal from the circuit 26, can now perform a few priming strokes predetermined by the circuit. The air in the pump is discharged through the discharge opening 14 and by means of the riser 20 medium is delivered into the pump cylinder. At least during the last of these priming strokes, whose number can be predetermined, some of the medium is sprayed out of the discharge nozzle 14 and is received by the storage space 44 and the storage element 45 contained therein. The storage space can be vented to the outside, although the sprayed in air/liquid quantity is very small. Venting preferably takes place through the storage element 45 and through the annular gap between the protective cap and casing, which can e.g. be an open-cell plastic foam and consequently also serves as a filter medium.

Only after performing these priming strokes does the circuit 26, which has e.g. counted said strokes by means of not shown contacts, release the protective cap. For this purpose the magnet is controlled in such a way that it moves over and beyond the priming position 46 in the direction of the arrow 29, against which the lever 32 strikes and pivots same clockwise. Thus, the locking bolt 36 is freed from the protective cap and the latter can be drawn off, optionally following a corresponding signal for the user. It is possible for the protective cap to spring off automatically after releasing the locking bolt 36. For this purpose a spring can be provided between the casing 12 and the protective cap. The user can now perform the useful strokes supplied by the circuit 26, e.g. two strokes, i.e. one for each nostril. Then the circuit again blocks the atomizer, in that the armature returns to the normal position shown in continuous line form in FIG. 1. Only at the end of the time interval preset by the manufacturer or adjustable e.g. by the doctor, is a further actuating cycle released, optionally without a priming cycle.

Pump actuation takes place in that the actuating plunger 23 pushes the container 13 upwards into the opening 22, whilst the piston rod 21 is supported by means of the connecting ram 17 on the casing 12. Therefore the pump cylinder moves against the pump piston and brings about a useful stroke, which forces the medium via the connecting channel 16 through the spraying nozzle 14. By corresponding pre-tensioning of the outlet valve said valve only opens when there is an adequate actuating pressure.

The blocking mechanism shown can be given a particularly low friction construction, e.g. by means of a pivotable locking cross controlled by an electromagnet. It is also possible to control the release provided following the priming stroke, instead of by a number of strokes, by the result of a moisture indication from the storage element 45, e.g. by a moisture-sensitive contact located there.

Figure 2:
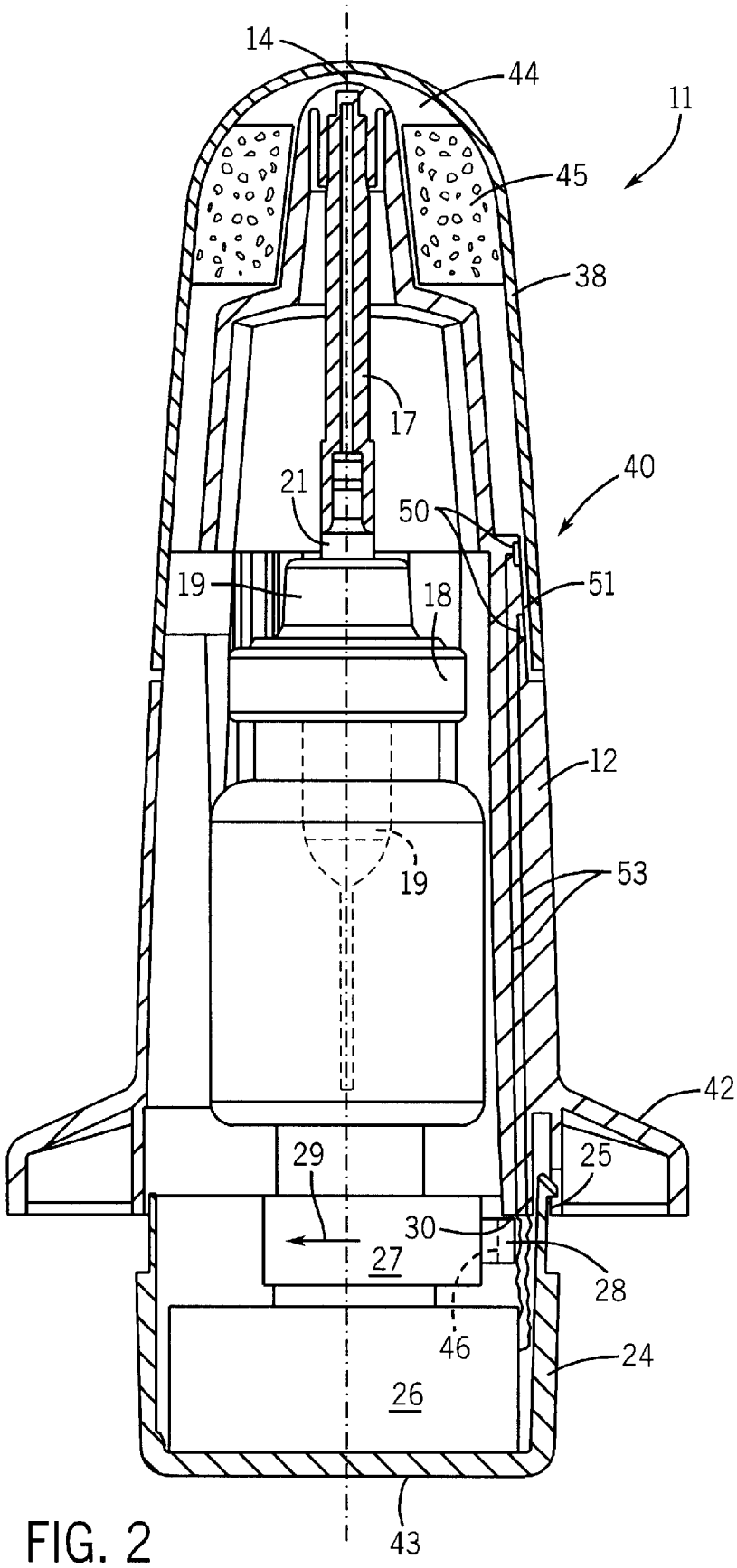
FIG. 2 A longitudinal section according to FIG. 1 with electric contact making for the presence of the protective cap.

FIG. 2 shows a dispenser with essentially the same mechanical structure compared with that of FIG. 1. However, the locking means 40 are not in the form of a mechanical protective cap locking, but form part of the circuit and a contact pair 50 controlling the latter and which cooperates with a contact bridge 51 in the interior of the protective cap 38, e.g. a metal foil located there. The armature 28 of the electromagnet 27 need only cooperate with the stop face 30 on the casing.

The function according to FIG. 2 is as follows. When the circuit 20 releases the dispenser for use for the first time, the armature 28 is drawn back into the position 46 and releases actuation. By exerting pressure between the actuating shoulders 42 and the actuating face 43, the user can actuate the dispenser for as long as priming is preprogrammed. However, release only takes place for as long as the two contacts 50, which are connected by lines 53 to the circuit 26, are closed by the contact bridge 51. This ensures that a priming actuation can only take place when the protective cap is fitted. The medium discharged is received in the manner described relative to FIG. 1 in the storage space 44/storage element 45 and consequently does not pass in atomized form into the atmosphere. Thus, it can have no action on persons not requiring treatment.

When the protective cap has been removed, the circuit releases the use cycle by releasing actuation for the normal useful strokes, then blocks the same for a circuit time following the predetermined number of strokes and only releases same again when this time has elapsed. This can take place for as long as the treatment cycle lasts. An intermediate priming action is in most cases unnecessary, because the pump, if it is tight, remains in the ready-to-operate state following the initial suction or priming. If a running empty of the pump is to be feared after a long period of time, a priming cycle could again take place and the prerequisite would be the refitting of the protective cap.

Figure 3:
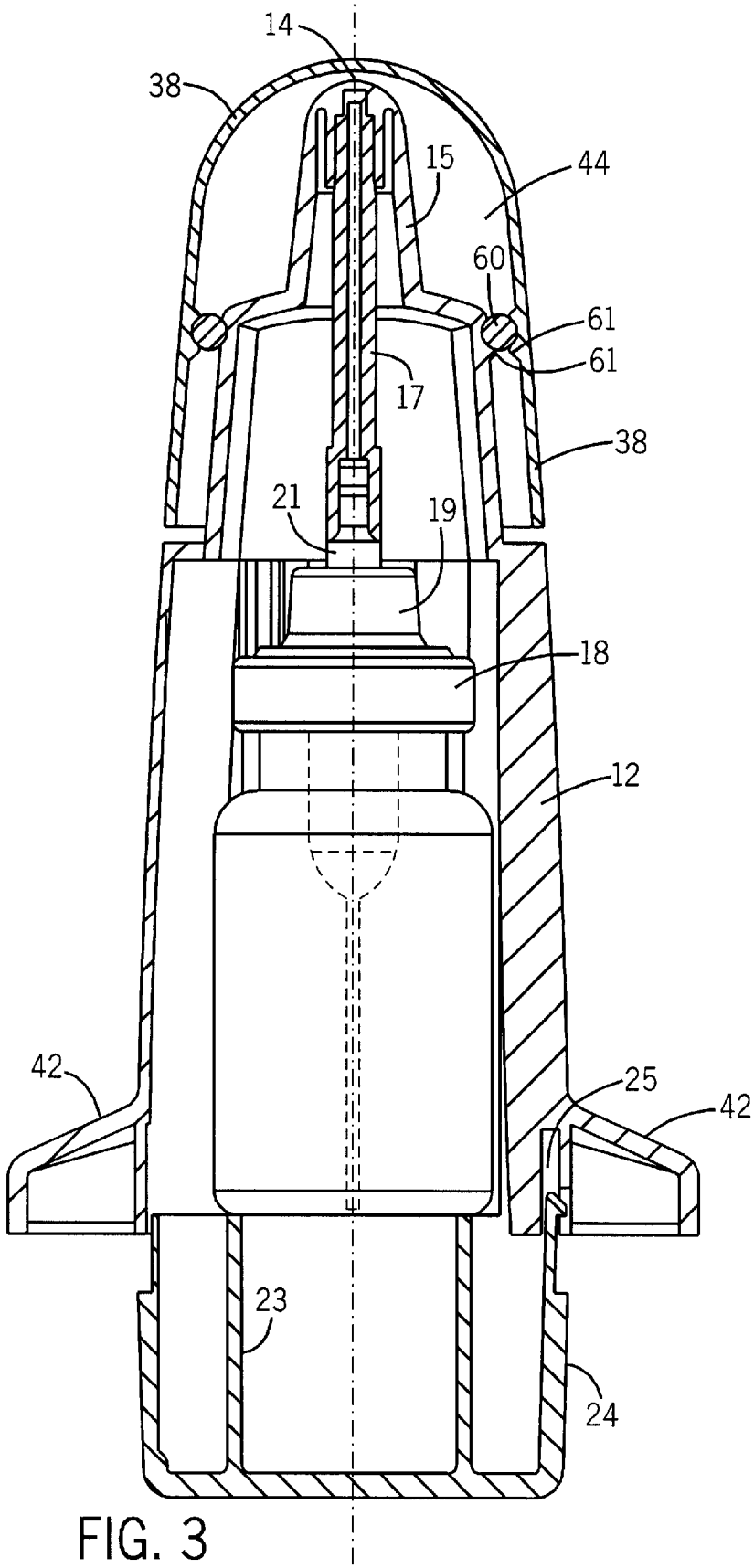
FIG. 3 A longitudinal section through a dispenser with a moisture-dependently operable lock or locking means for the protective cap.

FIG. 3 shows a dispenser, which has essentially the same mechanical construction as described hereinafter and reference should be made thereto. However, it contains no electrically or electronically controlled time lock and can instead be operated at any time. Correspondingly the actuating pusher 24 only has a tubular actuating plunger 23 in its interior. As locking means 40, the protective cap 38 has a mechanical lock in the form of a moisture-sensitive ring 60, which is held in corresponding retaining grooves or between retaining beads 61 on the inside of the protective cap or on the outside of the nose adapter 15, i.e. in the casing.

The ring 60 is made from a material which is solid in the dry state, but softens on absorbing moisture. This can e.g. be gelatin, a plastic foam coated with a soluble material or a similar material. The term moisture here refers to the medium. If the medium is to contain substances other than water as the carrier, then for the moisture-sensitive element 60 those materials are suitable which soften on contact with said medium constituent or modify their physical characteristics for the release of the protective cap. However, the moisture-sensitive element 60 need not be in the form of a ring, although this is the easiest to fit, but could instead bring about a blocking action for the protective cap in some other way. It is also possible to provide separate conduits, which guide the medium passing out of the discharge opening 40 to the element or elements 60.

The function according to FIG. 3 is such that the dispenser is actuated in the described manner and after priming has taken place sprays at least one stroke into the storage space 44 between the protective cap and the nose adapter. The medium then runs down the walls of said storage space to the element 60, softens the latter and in this way the protective cap 38 previously seated firmly on the casing 12 can be drawn off. It is then possible to continue working with normal useful strokes.

Here again a time-dependent control in the above-described manner or according to U.S. Pat. No. 6,234,366 would be possible.

Figure 4:
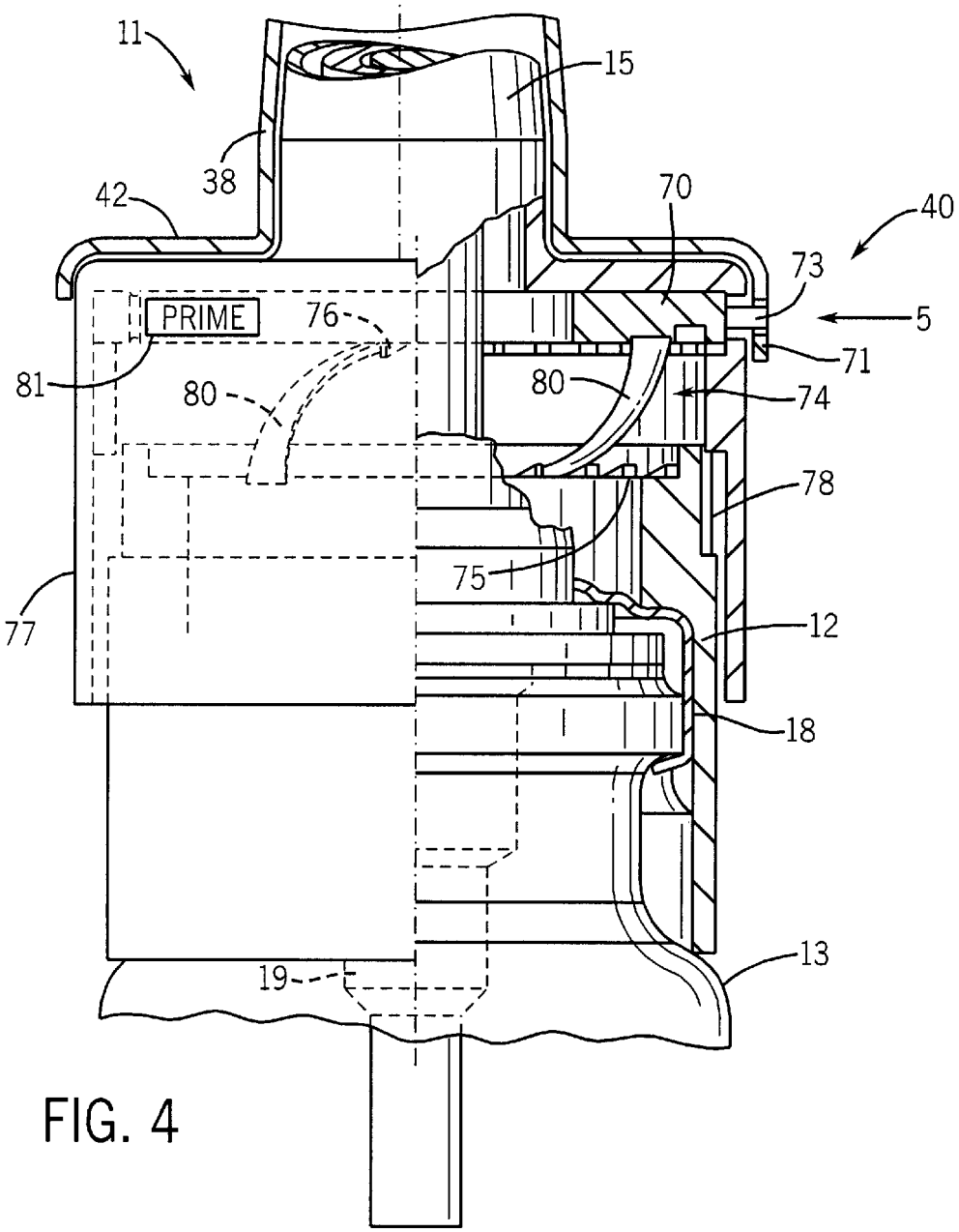
FIG. 4 A part longitudinal section through a dispenser with a mechanical lock for the protective cap through a counting ring.
Figure 5:
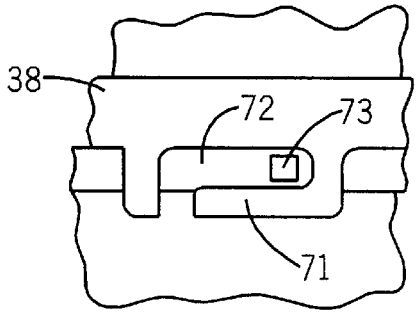
FIG. 5 A plan view of a detail of FIG. 4 in accordance with arrow V.

The same applies for the construction according to FIGS. 4 and 5, which show a mechanical protective cap locking, which is controlled by a counting ring 70.

The protective cap 38 located on the nose adapter 15 covers the actuating shoulders 42. In a marginal projection 71 of the protective cap is provided an angular recess 72 (FIG. 5) in the manner of a rocker arm, in which is located a latch pin 73 projecting from the counting ring 70 and which prevents the removal of the protective cap 38.

The counting ring 70 is driven by a ratchet 74, which is provided with in each case one ring of saw-tooth-like teeth 75, 76 on the counting ring and on a casing part 12 mounted on the crimping closure 18 of the container 13. Both the counting ring 70 and casing part 12 have one or more resilient, bent transfer pawls 80, which are injection molded onto the same and with which cooperate facing locking teeth. The counting ring 70 is provided on the actuating sleeve 77, which has the actuating shoulders 42 and is in fact secured against rotation on the casing by a groove and tongue guide 78, but can be moved towards the casing 12 in an axial direction counter to the tension of a separate or a pump-internal spring, if a user presses on the actuating shoulders 42.

On approaching the counting ring 70 and casing part 12 the resilient link plates or pawls 80 extend circumferentially and consequently move on in the circumferential direction the counting ring, so that it is turned by one step, because its free end cooperates with in each case one of the teeth 75, 76. On releasing the actuating sleeve 77 the spring presses it further upwards, so that the pawl 80 following the inclination of the teeth and its own inclined position can advance by one further tooth. A turning back can be prevented by corresponding frictional or locking conditions or ratios.

After assembly the dispenser is supplied in a state in the manner symbolized by FIG. 5. The pin 73 is in the recess 72 and in this way prevents the drawing off of the protective cap 38. Simultaneously in the counting window 81 appears an instruction to carry out priming actuation, e.g. the word "PRIME". By pressure on the actuating shoulders 42, the user now actuates the dispenser until this word has disappeared, in that the counting ring has advanced by a few steps. When this has taken place, the pin 73 has passed out of the recess 72 and the protective cap can be removed. In the counting window then appears an instruction to carry out the useful actuation or the corresponding number of strokes. This count can either be continuous, if the patient is to receive a given number of doses during a treatment cycle or there could be a repeating number of e.g. four strokes, i.e. indicated by the numbers 1 to 4, or there could be an instruction to change the treatment position (e.g. right or left nostril).

Thus, as a result of the invention described in the preceding examples, it is ensured that the priming actuation of the dispenser can be safely carried out without the medicament to be discharged being released during the priming stroke and instead it is always received in a protective cap, in that up to the end of the priming stroke or strokes either the protective cap or dispenser actuation is blocked. This is particularly important for certain types of pharmaceuticals, which are present in flowable form, i.e. either in the liquid or pasty or pulverulent state.

What is claimed is:

1. Dispenser for at least one medium comprising:

a pump (19) operable for dispensing the medium in consecutive dispensing strokes, the pump having an inlet (20) connected to a source (13) of said medium and an outlet connected to a discharge opening (14), and the pump requiring for priming at least one priming stroke;

a protective cap (38) being provided to cover at least the discharge opening (14) before use, said cap being removable to uncover the discharge opening (14) and to allow the dispensing strokes; and locking means for ensuring said at least one priming stroke with the protective cap fitted on the dispenser, and before removal of said protective cap to allow the dispensing strokes.

2. Dispenser according to claim 1, wherein the locking means (40) lock the protective cap (38) on the dispenser (11) until said at least one priming stroke has been performed.

3. Dispenser according to claim 1, wherein the locking means (40) block actuation of the pump (19) with the protective cap (38) removed until a predetermined number of priming strokes are performed with the protective cap (38) fitted in a covering position.

4. Dispenser according to claim 1, wherein the locking means (40) are actuated electrically.

5. Dispenser according to claim 1, further comprising an actuation release circuit (26) controlling the locking means including a timing circuit.

6. Dispenser according to claim 1, wherein the locking means (40) have a mechanically releasable lock (32, 37; 50, 70, 73).

7. Dispenser according to claim 1, wherein the locking means include an ejecting mechanism for the protective cap (38).

8. Dispenser according to claim 6, wherein the lock (70 to 73) includes a counting device for pump strokes.

9. Dispenser according to claim 1, wherein the protective cap contains storage means (44, 45) for medium discharged during the at least one priming stroke.

10. Dispenser according to claim 9, wherein the storage means is constructed as a filter element with venting to outside of the dispenser.

11. Dispenser according to claim 1, wherein the discharge opening (14) is a spray nozzle.

12. Dispenser for at least one medium comprising: a pump (19) dispensing the medium in consecutive strokes; the pump having an inlet (20) connected to a source (13) of said medium and an outlet connected to a discharge opening (14), the pump requiring for priming at least one priming stroke; a protective cap (38) being provided to cover at least the discharge opening (14) before use; and locking means ensuring said at least one priming stroke with the protective cap fitted on the dispenser, said locking means having moisture-dependent components.

13. Dispenser according to claim 12, wherein the moisture-dependent components have electrical characteristics modified by media contact.

14. Dispenser according to claim 12, wherein the moisture-dependent components (60) have mechanical characteristics modified by media contact.

* * * * *

UNITED STATES PATENT AND TRADEMARK OFFICE

CERTIFICATE OF CORRECTION

PATENT NO. : 6,578,741 B2
DATED : June 17, 2003
INVENTOR(S) : Stefan Ritsche et al.

It is certified that error appears in the above-identified patent and that said Letters Patent is hereby corrected as shown below:

Column 3,
Line 4, “patent” should read -- a patient --.

Signed and Sealed this

Twentieth Day of April, 2004

JON W. DUDAS
*Acting Director of the United States Patent and Trademark Office*